United States Patent [19]

Baker

[11] Patent Number: 4,635,896

[45] Date of Patent: Jan. 13, 1987

[54] METHOD OF SEALING A JOINT BETWEEN AN INGOT MOLD AND A STOOL AND RESULTING ASSEMBLY

[76] Inventor: Edwin L. Baker, Box 487, 102 Baker Ave., Scottsville, Tex. 75688

[21] Appl. No.: 848,222

[22] Filed: Apr. 4, 1986

[51] Int. Cl.[4] ..... B22D 7/06

[52] U.S. Cl. ..... 249/135; 164/137; 164/342; 249/174; 249/204; 277/236

[58] Field of Search ..... 164/137, 342; 249/174, 249/204, 206, 135, 160, 187 R; 277/236

[56] References Cited

U.S. PATENT DOCUMENTS 1,207,572 12/1916 Law et al. ..... 249/174 X
1,649,522 11/1927 Gathmann ..... 249/160 X
2,647,770 8/1953 Tollefsbol ..... 277/236 X
3,313,553 4/1967 Gastineau ..... 277/236 X
4,465,117 8/1984 Mason ..... 164/137

FOREIGN PATENT DOCUMENTS 1245537 10/1960 France ..... 249/204

*Primary Examiner*—Nicholas P. Godici
*Assistant Examiner*—J. Reed Batten, Jr.
*Attorney, Agent, or Firm*—Richard C. Litman

[57] ABSTRACT

The space between the open bottom mold and the supporting stool used for casting ingots is sealed by placing a thin wall steel tube between the mold and the stool. The weight of the mold partially collapses the tube causing the surfaces of the tube to conform to both the surfaces of the mold and the stool, thus forming a seal.

8 Claims, 5 Drawing Figures

METHOD OF SEALING A JOINT BETWEEN AN INGOT MOLD AND A STOOL AND RESULTING ASSEMBLY

BACKGROUND OF THE INVENTION

This invention relates to the casting of steel ingots, more particularly to such casting in which "open bottom" molds are supported by flat slabs, called "stools", usually of cast iron. These molds conventionally are rectangular and of decreasing cross-section from bottom to top to facilitate removal of the ingots from the molds when they have cooled sufficiently.

Due to irregularities in the surface of the stools and in the bottom rim of the molds arising in the manufacture as well as caused by erosion in the use of these elements, the joint between the rim and the stool is not tight. To prevent flow of molten metal through this space, with consequent loss of metal poured if the space is great, or the development of "stickers" if the space is minor, various expedients have been suggested or used to seal the joint.

One such means is the use of a sealant in a deformable tubular container covered with cardboard. The container may be designed to rupture in use. Such a means is disclosed in U.S. Pat. No. 4,369,830. An expanded metal seal is disclosed in U.S. Pat. No. 4,135,589. Tubular sealing means are shown in valves in U.S. Pat. No. 1,043,065.

SUMMARY OF THE INVENTION

The present invention is an improvement in the seal used in the combination of a steel ingot mold having an open bottom with a rim and a stool below said rim for supporting the mold. The improvement is a deformable metal tubular sealing means positioned between the open bottom and the stool. The tubular sealing means is an iron or steel tube having a circular cross section positioned between the rim of the mold and the stool. The weight of the mold causes the tube to deform to conform to the irregularities in the rim and the stool and thereby form a seal. In a preferred embodiment the tube has a diameter of one inch and a wall thickness of 0.035 inches. Preferably the sealing means is set back from the inner edge of the rim, so that metal poured into the mold will be cooled by passing between the space between the rim and the stool before contacting the sealing means where it solidifies.

The method of sealing a joint between a steel ingot mold having an open bottom with a rim and a stool below the rim for supporting the mold is practiced by applying a deformable metal tubular sealing means between the open bottom and the stool.

DETAILED DESCRIPTION

Figure 1:
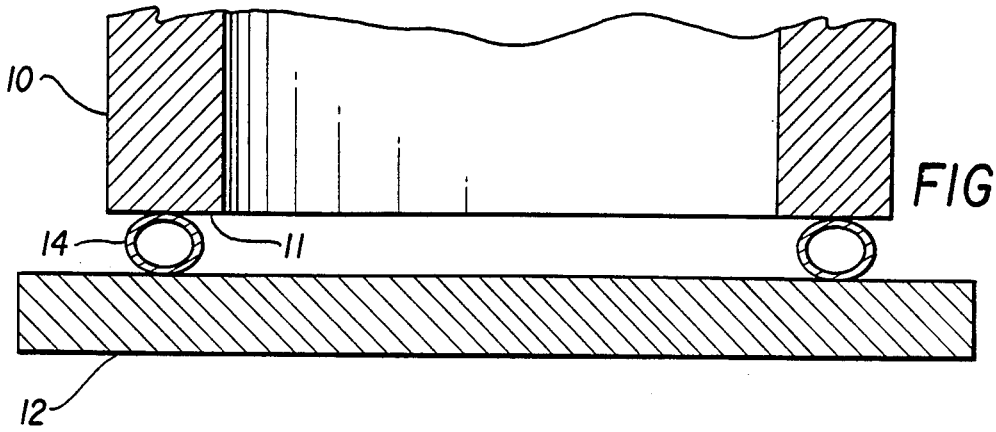
FIG. 1 is a sectional view of the lower portion of a mold and stool assembly, including a seal according to the invention.

Referring now to FIG. 1, the space between the lower portion of mold 10, and its supporting stool 12 is sealed by seal 14. The seal 14 is a preformed steel pipe, one inch in diameter and having a wall thickness of 35 one thousandths of an inch, such as that represented by

Figure 2:
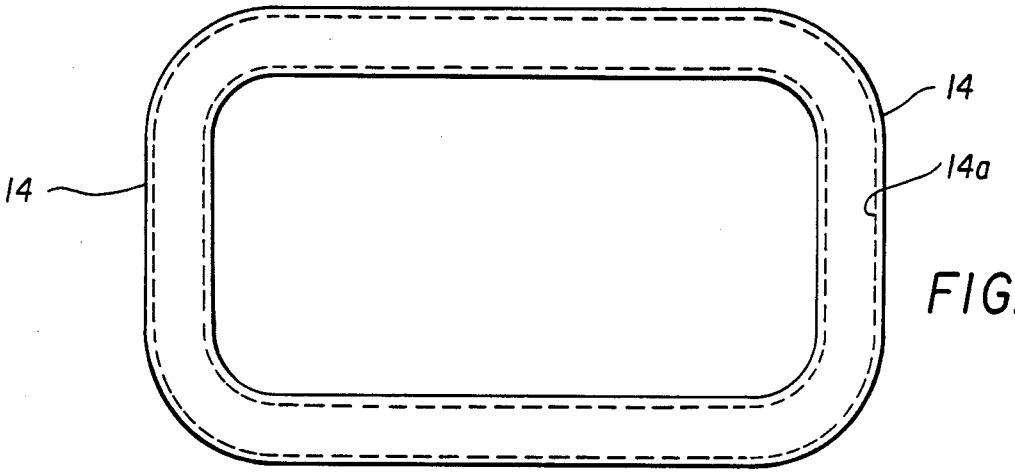
FIG. 2 is a plan view of the seal of FIG. 1.
Figure 3:
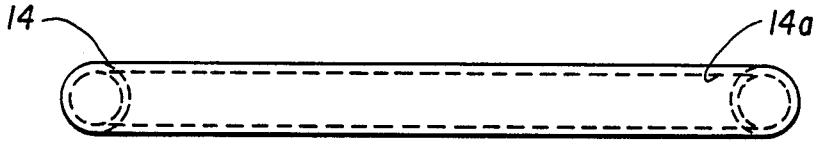
FIG. 3 is a cross sectional view of the seal of FIG. 2.

14*a* in FIGS. 2 and 3. The exact size of seal 14 is not critical so long as it substantially closes and thus seals the space. The wall of seal 14 must be thin enough to collapse partially to conform to surface irregularities in the bottom rim 11 of mold 10 and the supporting surface of stool 12. The wall of the seal 14 however must be thick enough to support mold 10 without completely collapsing.

Figure 4:
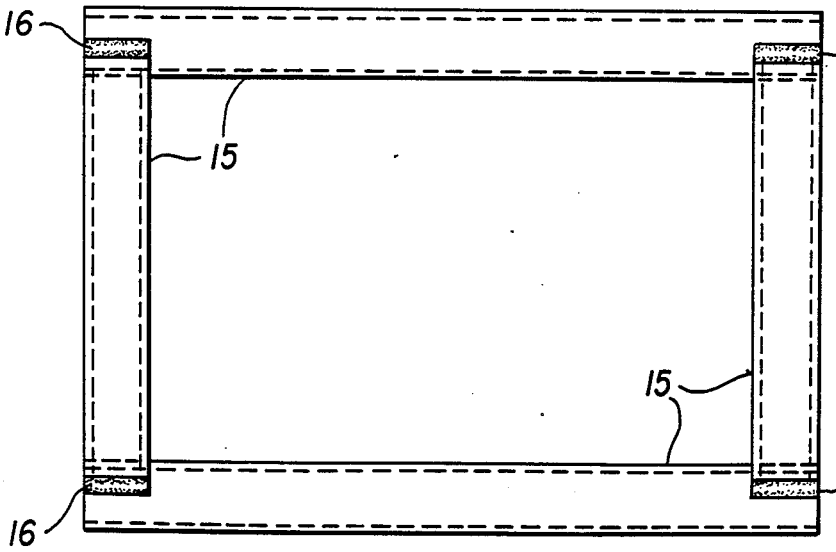
FIG. 4 is an alternate embodiment of the seal of FIG. 2.
Figure 5:
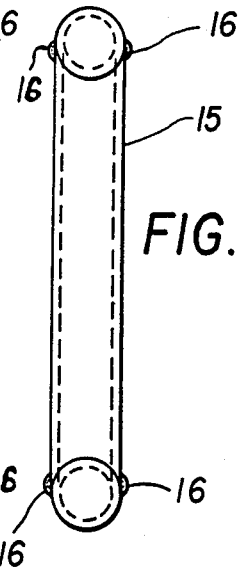
FIG. 5 is a side view of the seal of FIG. 4.

Instead of a one piece sealed tube of thickness 14*a*, the seal can also take the form of four steel tubes 15 welded together at their joints, as is shown in FIG. 4. The welds 16 join the tubes together but do not seal them.

It is preferable that seal 14 be placed so that the steel that is cast must flow under the bottom rim 11 of mold 10 to partially cool the steel before it contacts seal 14 where it solidifies.

The seal of the present invention is impervious to weather conditions, and can be stored outside or in otherwise inclement conditions such as one finds in steel making operations. Being steel, it does not dry out and crumble as do ceramic type seals. It is able to seal off a crevice up to one diameter of the tubular material used in seal construction. It is made of readily accessible material, and is inexpensive as compared to other more complicated seals. Since the seal of the present invention is rigid and weather resistant, the packaging of the seal is much simpler than with other seals as other seals tend to get mashed at lower levels of the package. No contamination of ingot steel occurs, as does occur with many of the non metallic seals. The seal of the present invention also greatly reduces the percentage of leakers as compared to other types of seals.

I claim:

1. In combination, a steel ingot mold having an open bottom with a rim, a stool below said rim for supporting said mold, wherein the improvement consists essentially in a deformable metal tubular sealing means positioned between said open bottom and said stool.

2. The improvement of claim 1 wherein the rim has an inner edge and the improvement is further characterised by the sealing means being set back from the inner edge under the rim, so that metal poured into the mold will be cooled by passing between a space between the rim and the stool before contacting the sealing means where it solidifies.

3. The improvement of claim 1 further characterised by the tubular sealing means being an iron or steel tube having a circular cross section.

4. The improvement of claim 3 further characterised by the tube having a diameter of one inch and a wall thickness of 0.035 inches.

5. A method of sealing a joint between a steel ingot mold having an open bottom with a rim and a stool below said rim for supporting said mold, wherein the improvement consists essentially in applying a deformable metal tubular sealing means between said open bottom and said stool.

6. The improvement of claim 5 wherein the rim has an inner edge and the improvement is further characterised by the sealing means being set back from the inner edge under the rim, so that metal poured into the mold will be cooled by passing between a space between the rim and the stool before contacting the sealing means where it solidifies.

7. The improvement of claim 5 further characterised by the tubular sealing means being an iron or steel tube having a circular cross section.

8. The improvement of claim 7 further characterised by the tube having a diameter of one inch and a wall thickness of 0.035 inches.

* * * * *